US006030352A

United States Patent [19]

Paik

[11] Patent Number: 6,030,352

[45] Date of Patent: Feb. 29, 2000

[54] PHYSICAL EXERCISE DEVICE USING T-SHAPED BAR

[76] Inventor: Sung-Yun Paik, 501-25, Jangjun-2Dong, Gumjung-Gu, Pusan, Rep. of Korea

[21] Appl. No.: 09/189,904

[22] Filed: Nov. 12, 1998

[30] Foreign Application Priority Data

Nov. 14, 1997 [KR] Rep. of Korea ..... 97-60164
Dec. 23, 1997 [KR] Rep. of Korea ..... 97-72701

[51] Int. Cl.[7] ..... A61H 1/100

[52] U.S. Cl. ..... 601/23; 601/64; 601/31; 601/46; 601/53; 601/27; 601/85; 482/904

[58] Field of Search ..... 601/46, 49, 53, 601/54, 59, 60, 67, 69, 70, 85, 23, 24, 27, 30, 31, 34, 89–93; 482/904, 79, 80, 146, 147

[56] References Cited

U.S. PATENT DOCUMENTS

| | | | |
|---|---|---|---|
| D. 237,654 | 11/1975 | Agatani | 601/24 X |
| 2,273,088 | 2/1942 | Byers | 601/24 X |
| 2,645,219 | 7/1953 | Bertholin | 601/24 X |
| 2,915,055 | 12/1959 | Matton | 601/24 |
| 4,860,733 | 8/1989 | Parker | 601/24 |
| 5,468,215 | 11/1995 | Park | 601/23 |

FOREIGN PATENT DOCUMENTS

| | | | |
|---|---|---|---|
| 1292358 | 3/1962 | France | 601/27 |
| 2390179 | 12/1978 | France | 482/904 |
| 2273658 | 6/1994 | United Kingdom | 601/27 |

*Primary Examiner*—Richard J. Apley
*Assistant Examiner*—Denise Pothier
*Attorney, Agent, or Firm*—Nawrocki, Rooney & Sivertson, P.A.

[57] ABSTRACT

A physical exercise device using a T-shaped bar, comprises: a vertical rod constituting the T-shaped bar and having a plurality of first height-adjusting holes; a hollow vertical rod telescopically fitted around the vertical rod and having a plurality of second height-adjusting holes; a horizontal rod horizontally secured to the hollow vertical rod and having a pair of footrests fixed thereto; a pair of vane-shaped cushioning plates attached to the pair of footrests, respectively, and each having a thinner front and a thicker rear; a base having a projection formed at one end thereof; and a seat secured onto the base and having a higher front and a lower rear. According to the present invention, it is possible to effectively conduct a leg exercise for relieving the leg muscles' fatigue by relaxing the sole muscles and the calf muscles, a thigh exercise for relieving the thigh muscles' fatigue by relaxing the thigh muscles, back and neck exercises for relieving the back muscles and neck muscles' fatigue by relaxing the back muscles and the neck muscles, and a groin exercise for relieving the groin muscles' fatigue by relaxing the groin muscles, whereby a massage effect is afforded and an exercise of the whole body is made possible.

3 Claims, 12 Drawing Sheets

PHYSICAL EXERCISE DEVICE USING T-SHAPED BAR

BACKGROUND OF THE INVENTION

1. Field of the Invention

The present invention relates to a physical exercise device, and more particularly, the present invention relates to a physical exercise device using a T-shaped bar, in which a horizontal rod having attached thereto a vane-shaped cushioning plate of a thinner front and a thicker rear is secured to an upper end of a vertical rod oscillated in a predetermined range of oscillation frequency, to afford a massage effect and allow an exercising of the whole body.

2. Description of the Prior Art

Recently, physical exercise for the body has been vigorously conducted since various physical exercise devices are developed. However, although these physical exercise devices effect different areas of the body through different exercise techniques or methods, it is difficult to conduct a multitude of exercises by using only one physical exercise device. Therefore, in order to make it possible to conduct a multitude of exercises by one physical exercise device, the device requires an increased number of components, by which it is complicated in its structure.

The present invention has been made in view of the above problem and to provide a physical exercise device using a T-shaped bar, through which a multitude of exercises can be conducted with a simple structure.

In the Korean Utility Model Laid-open Gazette No. 94-24410 (1994. 9. 17), there is described a health/exercise machine in which a footrest which performs a finger-pressure type treatment is arranged above a T-shaped bar and an oscillating plate, performing an oscillating movement, is arranged in front of the T-shaped bar. In this health/exercise machine, while it is possible to conduct exercises by drawing inward the footrest as occasion needs, the exercises conducted over the drawn footrest cannot but be restricted in their number. Also, as a separate arrangement is provided for the oscillating movement, it is no more than an addition to the health/exercise machine. Accordingly, there is little difference in simplicity of structure between such a health/exercise machine and other known physical exercise devices.

Also, in the Korean Utility Model Laid-open Gazette No. 94-27538 (1994. 10. 21), there is disclosed a whole body exercise device in which a footrest is arranged above a T-shaped bar and an oscillating plate, provided for an oscillating movement, is arranged in front of the T-shaped bar. In this device, it is possible to conduct exercises by using the footrest and a belt hanging from the T-shaped bar. However, exercise performed by using the footrest is limited to those exercises effecting only the heel of the foot, and separate arrangements should be added to provide exercises for the neck, arms and waist by using the belt. Therefore, the whole body exercise device is no more than a machine that provides effect to different areas of the body by adding the separate arrangements.

SUMMARY OF THE INVENTION

Accordingly, the present invention has been made in an effort to solve the problems occurring in the prior art, and an object of the present invention is to provide a physical exercise device using a T-shaped bar, in which a horizontal rod, having attached thereto a vane-shaped cushioning plate of a thinner front and a thicker rear, is secured to an upper end of a vertical rod oscillated in a predetermined range of oscillation frequency, to afford a massage effect and allow an exercise of the whole body.

To achieve the above object, according to the present invention, there is provided a physical exercise device using a T-shaped bar, comprising: a vertical rod constituting the T-shaped bar and having a plurality of first height-adjusting holes; a hollow vertical rod telescopically fitted around the vertical rod and having a plurality of second height-adjusting holes; a horizontal rod horizontally secured to the hollow vertical rod and having a pair of footrests fixed thereto; a pair of vane-shaped cushioning plates attached to the pair of footrests, respectively, and each having a thinner front and a thicker rear; a base having a projection formed at one end thereof; and a seat secured onto the base and having a higher front and a lower rear.

By the features of the present invention, it is possible to effectively conduct a leg exercise for relieving the leg muscles' fatigue by relaxing the muscles of the sole of one' foot and the calf muscles, a thigh exercise for relieving the thigh muscles' fatigue by relaxing the thigh muscles, back and neck exercises for relieving the back muscles and neck muscles' fatigue by relaxing the back muscles and the neck muscles, and a groin exercise for relieving the groin muscles' fatigue by relaxing the groin muscles, whereby a massage effect is afforded and an exercise of the whole body is made possible.

BRIEF DESCRIPTION OF THE DRAWINGS

The above objects, and other features and advantages of the present invention will become more apparent after a reading of the following detailed description when taken in conjunction with the drawings, in which.

DETAILED DESCRIPTION OF PREFERRED EMBODIMENTS

Figure 1:
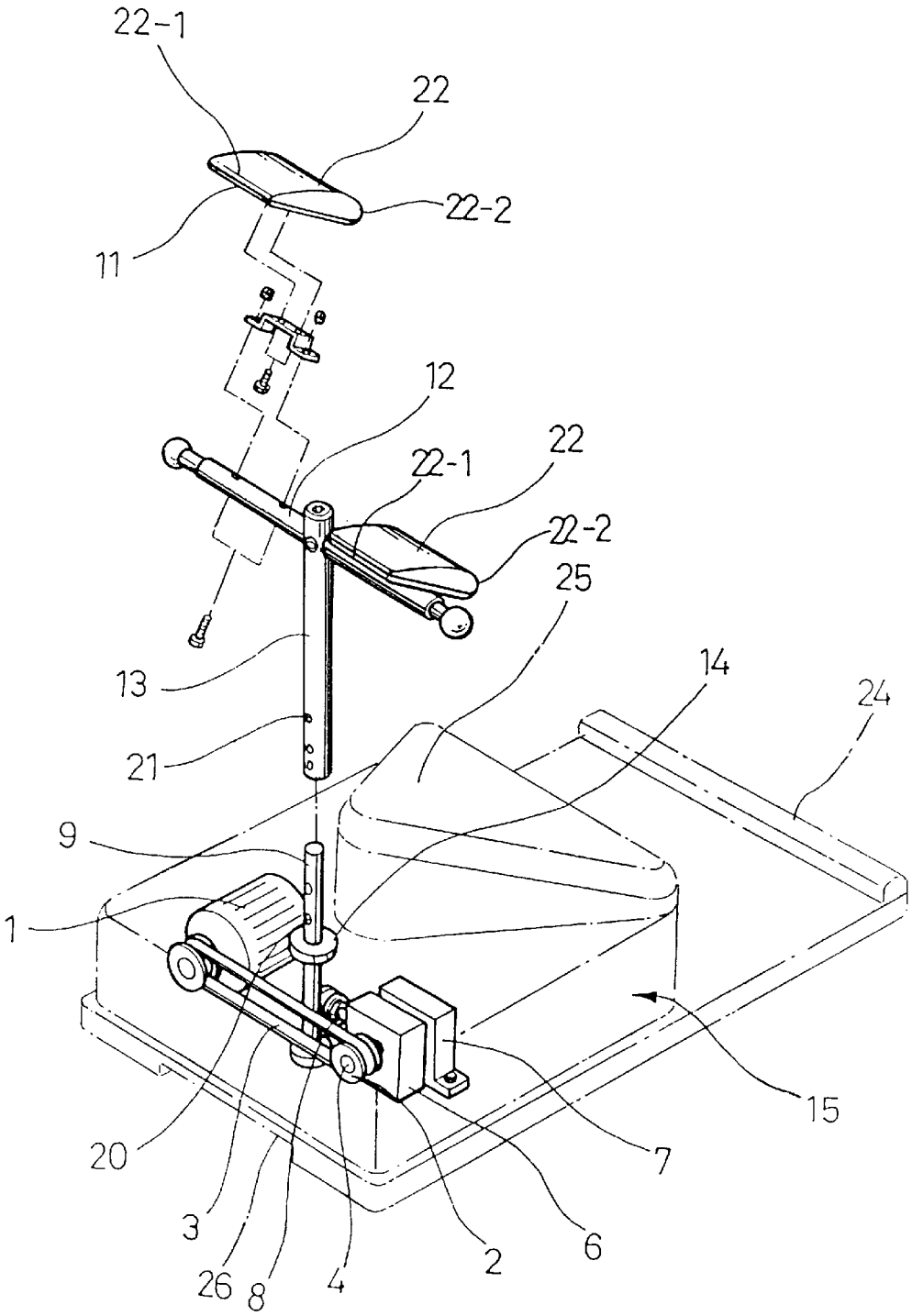
FIG. 1 is an exploded perspective view of a physical exercise device using a T-shaped bar, in accordance with an embodiment of the present invention.
Figure 2:
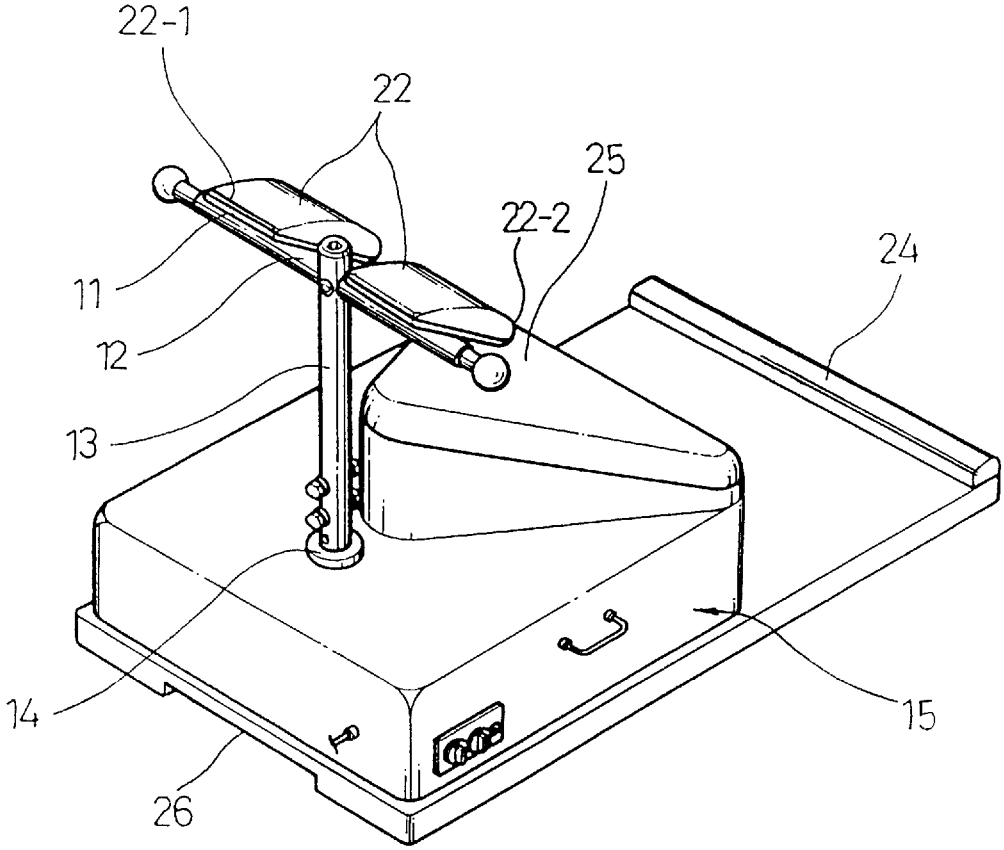
FIG. 2 is a perspective view of the physical exercise device of FIG. 1, which is in an assembled state.
Figure 3:
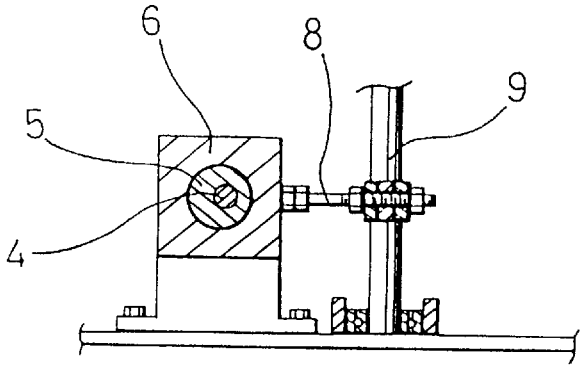
FIG. 3 is a cross-sectional view illustrating an oscillating member and a vertical rod which are connected with each other by a bar.
Figure 4:
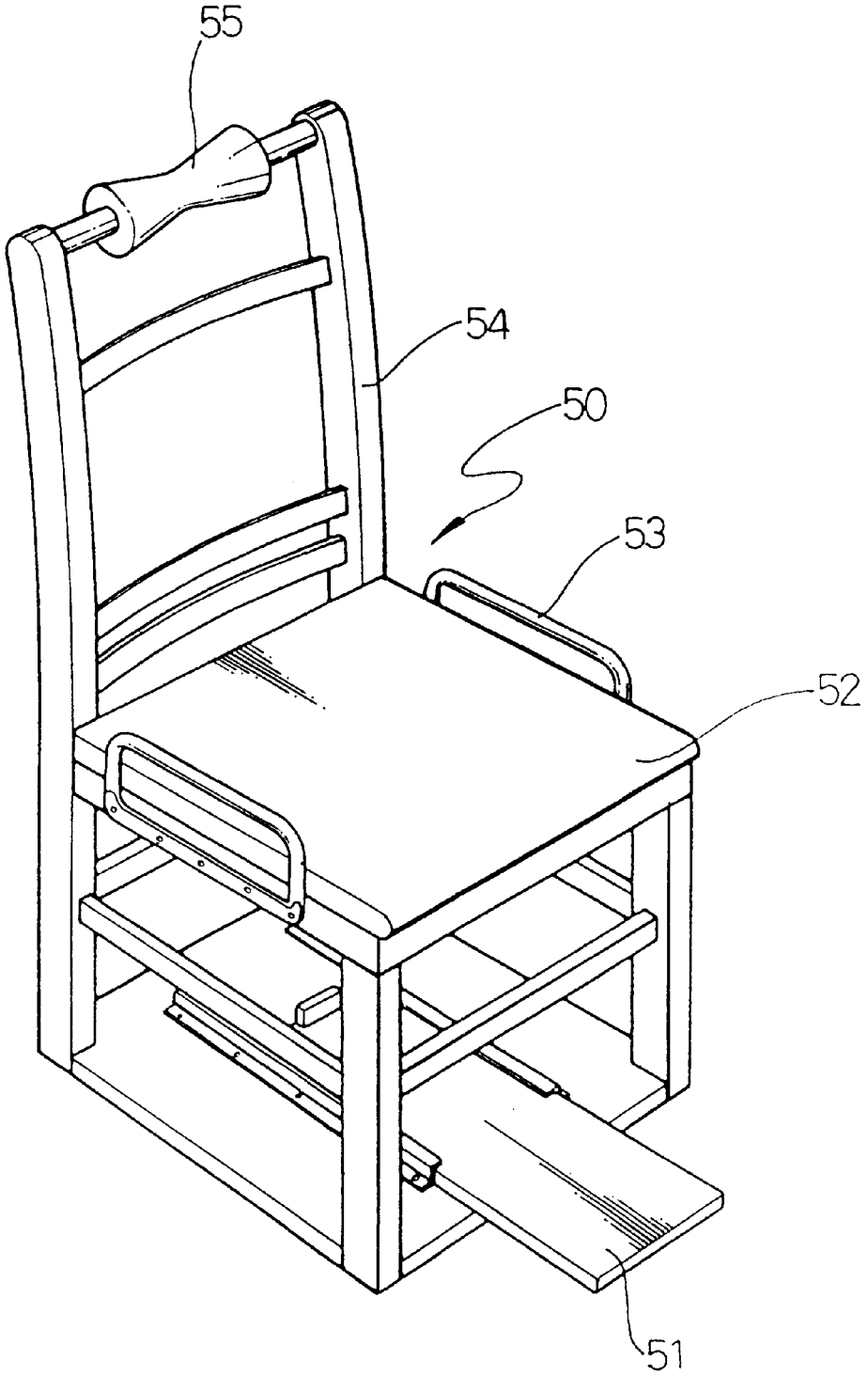
FIG. 4 is a perspective view of an auxiliary exercise chair constituting the physical exercise device of the present invention.

Reference will now be made in greater detail to a preferred embodiment of the invention, an example of which is illustrated in the accompanying drawings. Wherever possible, the same reference numerals will be used throughout the drawings to refer to the same or like parts.

Referring to FIGS. 1 through 4, a physical exercise device using a T-shaped bar according to the present invention includes a base 15. The base 15 has a projection 24 formed at a rear end thereof and a receiving groove 26 defined at a lower surface thereof. A motor 1 which has a reduction gear is mounted onto the base 15 for generating driving force. A rotating shaft 4 is coupled at one end thereof to a pulley 2 to be rotatably driven by the driving force which is generated by the motor 1. The driving force is transmitted to the rotating shaft 4 by way of a belt 3 through the reduction gear. An oscillating member 6 has an eccentric cam 5 which is fitted around the rotating shaft 4. The eccentric cam 5 allows the oscillating member 6 to be oscillated with rotation of the rotating shaft 4. A fixed member 7 is disposed adjacent to the reciprocating member 6 for rotatably supporting the other end of the rotating shaft 4. A connecting member 8 is connected at its one end to the oscillating member 6, and a vertical rod 9 is connected to the other end of the connecting member 8 to be integrally oscillated with the oscillating member 6. The vertical rod 9 has a plurality of first height-adjusting holes 20. A hollow vertical rod 13 is telescopically fitted around the vertical rod 9 and has a plurality of second height-adjusting holes 21. A horizontal rod 12 is horizontally secured to the hollow vertical rod 13 and has a pair of footrests 11 fixed thereto. A pair of vane-shaped cushioning plates 22 are attached to the pair of footrests 11, respectively. Each of the vane-shaped cushioning plates 22 has a thinner front 22-1 and a thicker rear 22-2. A triangle-shaped seat 25 is secured onto a center part of the base 15. The triangle-shaped seat 25 has a higher front and a lower rear. An auxiliary exercise chair 50 is detachably joined to the base 15. The auxiliary exercise chair 50 includes a sliding plate 51 engaged into the receiving groove 26 of the base 15, a pair of safety handles 53 secured to both sides of a seat part 52 thereof, and a headrest 55 secured to a back support 54 thereof.

In the physical exercise device using a T-shaped bar constructed as mentioned above, a vertical distance defined by the vertical rod 9 and the hollow vertical rod 13 can be adjusted by varying alignment positions between the plurality of first height-adjusting holes 20 and the plurality of second height-adjusting holes 21. Thus, a person exercising can freely use the physical exercise device of the present invention irrespective of his stature.

If the motor 1 is actuated by a switch operation, driving force induced by the rotation of the motor 1 is transmitted to the pulley 2 by way of the belt 3 through the reduction gear to rotate the rotating shaft 4. By the rotation of the rotating shaft 4, the eccentric cam 4 tightly fitted around the rotating shaft 4 is rotated, and the oscillating member 6 into which the eccentric cam 4 is embedded, is oscillated. As the oscillating member 6 is oscillated, the connecting member 8 is also oscillated. Accordingly, the oscillating movement of the oscillating member 6 is transmitted to the vertical rod 9 through the connecting member 8, and the vertical rod 9 is oscillated in a predetermined range of oscillation frequency.

Further, by this oscillating movement of the vertical rod 9, the hollow vertical rod 13, the horizontal rod 12, the pair of footrests 11 and the pair of vane-shaped cushioning plates 22 are also oscillated.

Hereinafter, various exercises conducted according to the present invention by using the vane-shaped cushioning plates 22 are described in detail:

A vertical distance defined by the vertical rod 9 and the hollow vertical rod 13 is first adjusted relying upon the stature of the person exercising.

Figure 5A:
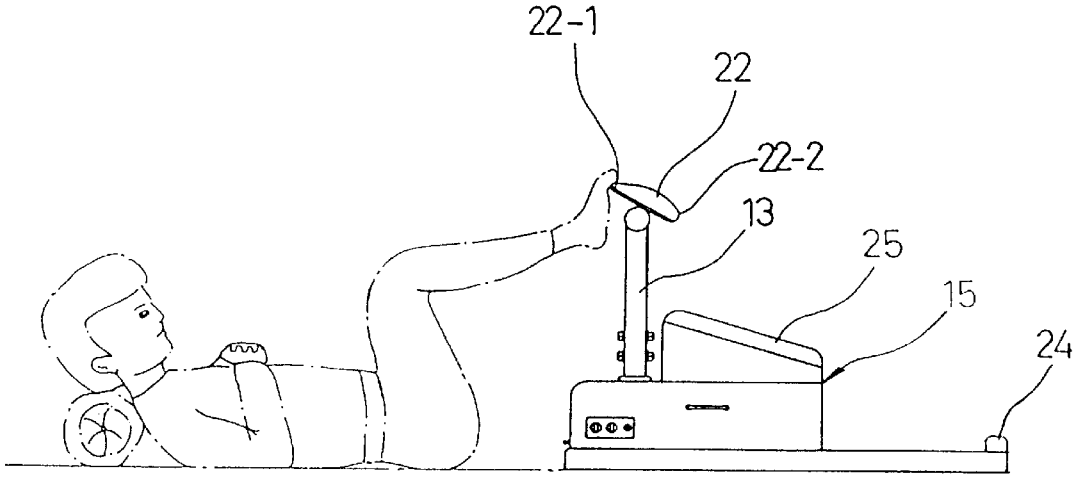
FIGS. 5A and 5B are side views showing a method of a leg exercise using the physical exercise device of the present invention.
Figure 5B:
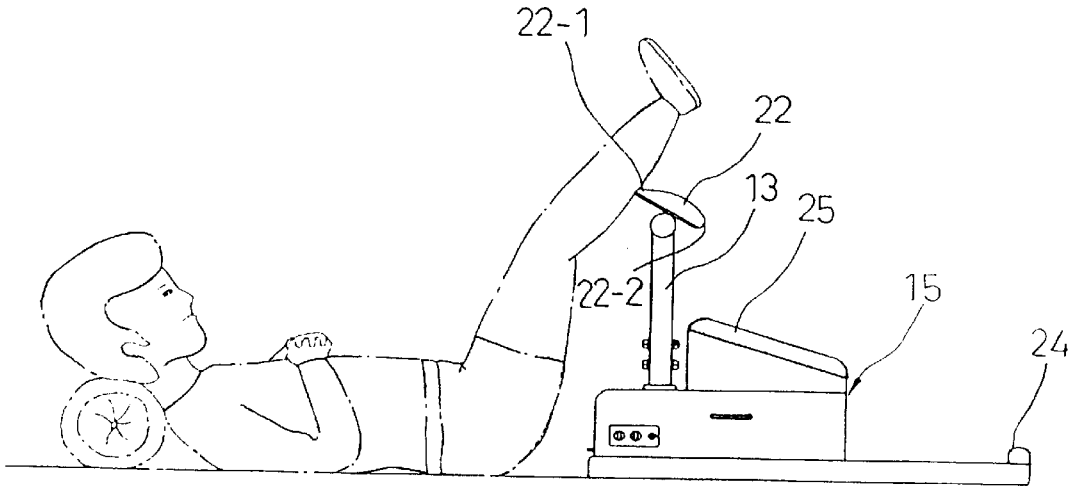
Figure 6A:
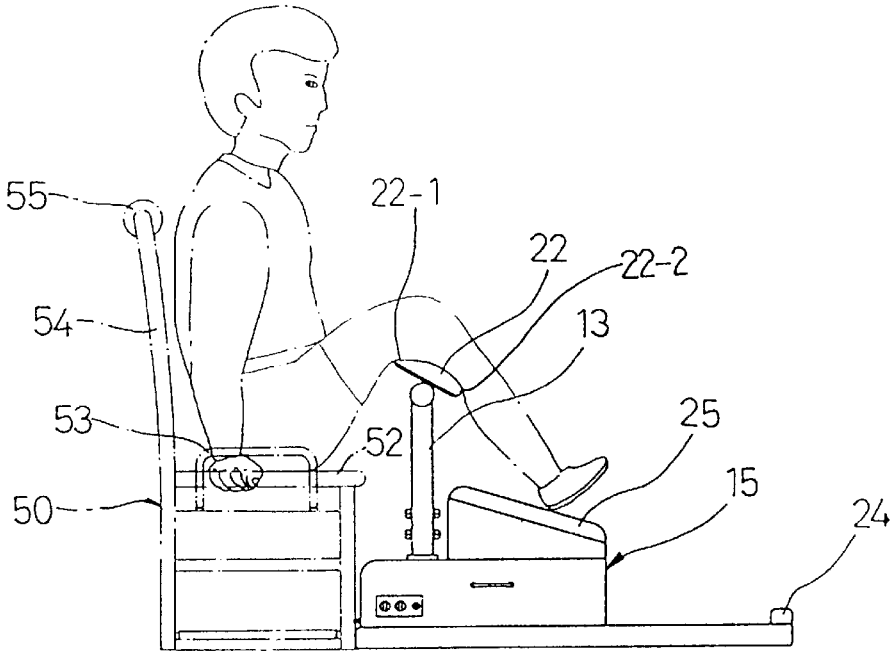
FIGS. 6A through 6D are side views showing a method of back and thigh exercises using the physical exercise device of the present invention.
Figure 6B:
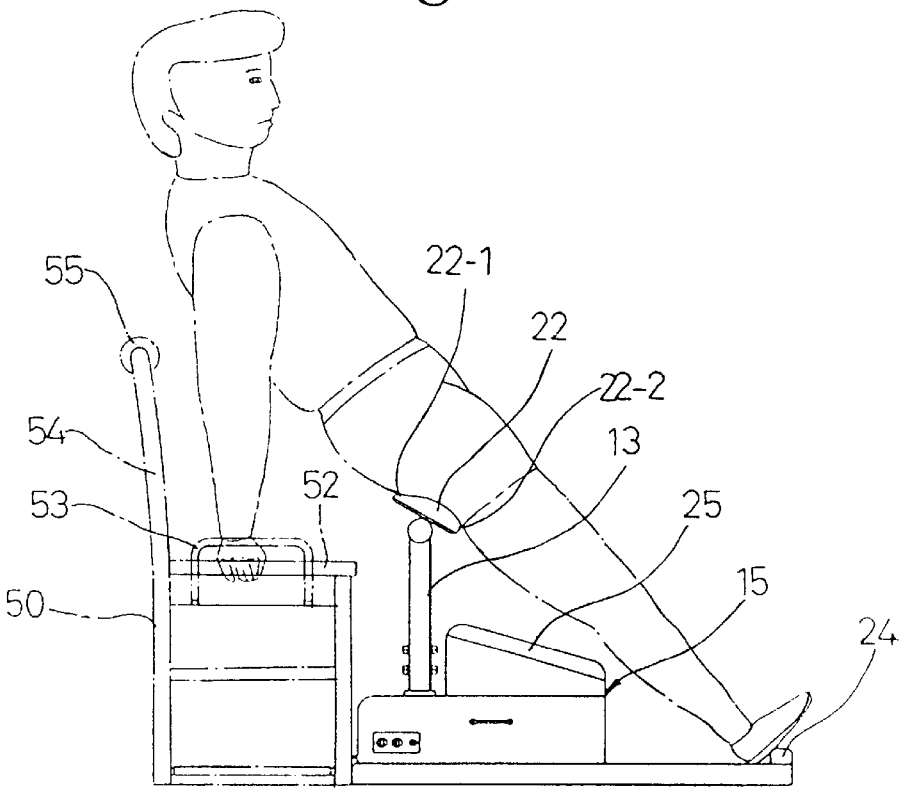
Figure 6C:
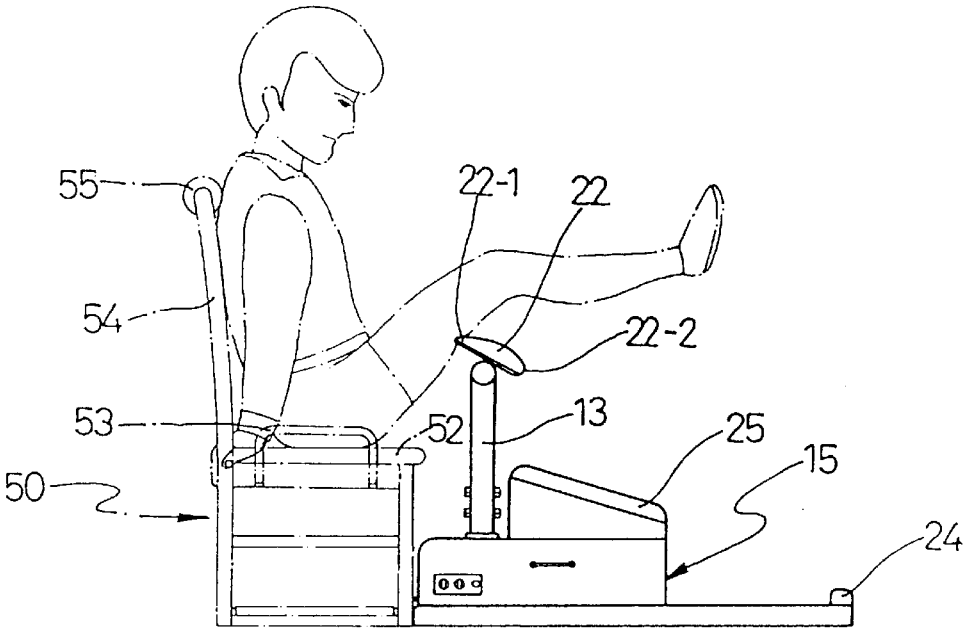
Figure 6D:
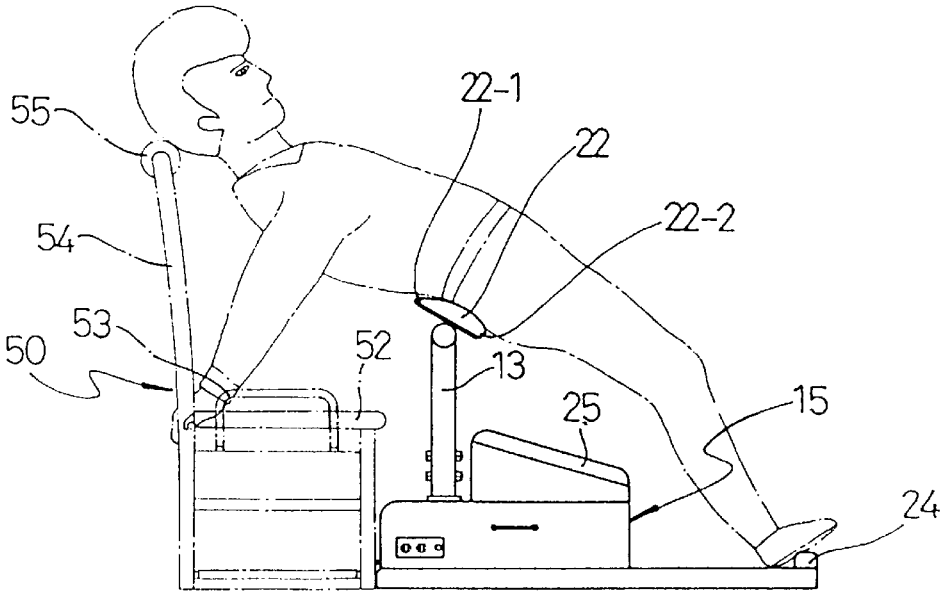
Figure 7A:
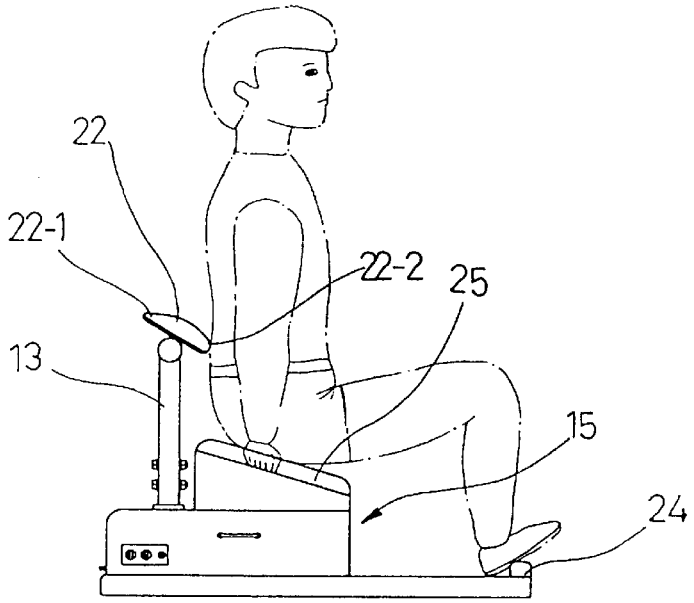
FIGS. 7A through 7D are side views showing a method of back and neck exercises using the physical exercise device of the present invention.
Figure 7B:
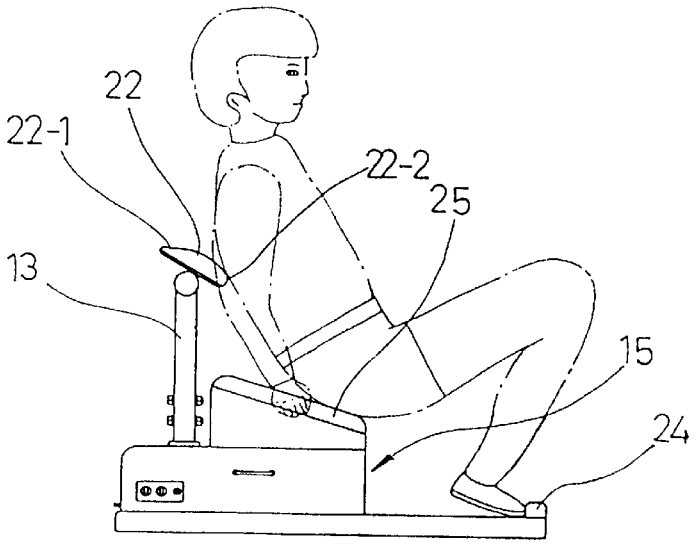
Figure 7C:
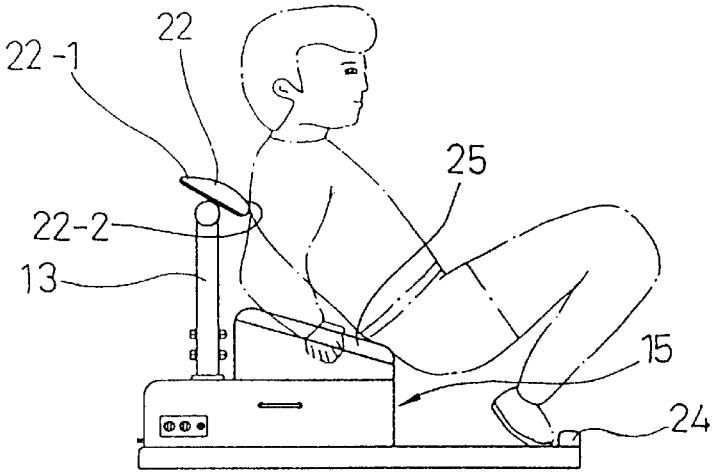
Figure 7D:
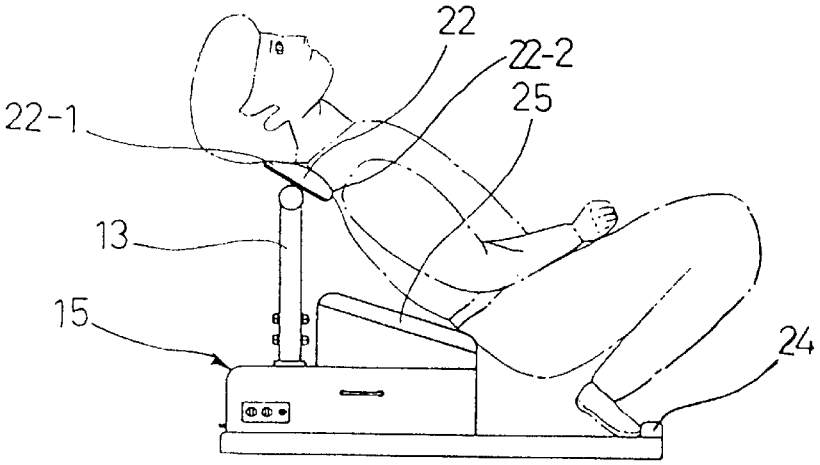

Referring to FIGS. 5A and 5B, there are illustrated side views showing a method of a leg exercise for relieving the leg muscles' fatigue by relaxing the sole muscles and the calf muscles.

The leg is pushed upward in a state that the joints between the sole of the foot and the toes depress the thinner front 22-1 of the vane-shaped cushioning plate 22 while a man lies down, such that the sole of the foot and the calf of the leg are brought into close contact with the thinner front 22-1 of the vane-shaped cushioning plate 22. At this time, since the vane-shaped cushioning plate 22 is oscillated together with the hollow vertical rod 13 and the horizontal rod 12 due to the oscillating movement of the vertical rod 9, fine vibrating force is moved through the sole, the heel and the calf to relax the sole muscles and the calf muscles.

By this action, the leg exercise can be spontaneously achieved due to the fact that the leg is pushed upward in a state that it depresses the thinner front 22-1 of the vane-shaped cushioning plate 22 while the man lies down, at the same time as the exercise for relieving the sole, the heel and the calf's fatigue is conducted.

As a result, it is possible to relieve fatigue by relaxing the sole muscles and the calf muscles and at the same time, to conduct the spontaneous leg exercise.

Referring to FIGS. 6A through 6D, there are illustrated side views showing a method of a thigh exercise for relieving the thigh muscles' fatigue by relaxing the thigh muscles.

In this method, the auxiliary exercise chair 50 detachably joined to the base 15 is advantageously used.

Initially, in a position adjacent to the front end of the base 15, the sliding plate 51 of the auxiliary exercise chair 50 is aligned with the receiving groove 26 of the base 15 and is pushed toward the rear end of the base 15 to be engaged into the receiving groove 26. In this way, the auxiliary exercise chair 50 is securely fixed to the base 15.

In this state, the back of the knee is positioned on an upper surface of the vane-shaped cushioning plate 22 and the heel of the foot is positioned on the triangle-shaped seat 25 having the higher front and the lower rear while the person exercising sits on the auxiliary exercise chair 50 and grasps both sides of the seat part 52 of the auxiliary exercise chair 50 by both hands, respectively. At this time, since outer parts of the arms are supported by inner parts of the safety handles 53 to be reinforced thereby, an accident in which hand is detached from the seat part 52 of the auxiliary exercise chair 50 can be prevented, whereby safety and stability can be enhanced.

Then, the upper body is raised from the auxiliary exercise chair 50 while the person exercising extends his arms.

By this exercise, when the upper body is raised from the auxiliary exercise chair 50 while the person exercising extends his arms, the joint between the calf and the thigh passes over the upper surface of the vane-shaped cushioning plate 22 and the thigh is positioned on the upper surface of the vane-shaped cushioning plate 22. Also, the heel of the foot slides on the triangle-shaped seat 25 which is secured onto the center part of the base 15 and has the higher front and the lower rear, until it is engaged to the projection 24 to cause the sole of the foot to be depressed against a corner portion of the projection 24. At this time, since the vane-shaped cushioning plate 22 is oscillated together with the hollow vertical rod 13 and the horizontal rod 12 due to the oscillating movement of the vertical rod 9, fine vibrating force is moved through the calf and the thigh of the leg to relax the calf muscles and the thigh muscles.

Accordingly, fatigue of the associated muscles is relieved. Also, by the fact that the back is straightened when the upper body is raised from the auxiliary exercise chair 50 while the person exercising extends his arms, it is possible to simultaneously conduct an arm exercise, a back exercise and an abdomen muscles exercise.

Hence, it is to be readily understood that the thigh exercise of the present invention is conducted to relax the joint between the calf and the thigh and the thigh muscles and to simultaneously achieve effects of the arm exercise, the back exercise and the abdomen muscles exercise.

In this exercise, as shown in FIGS. 6A through 6D, motion of the person exercising is performed in a state that the thighs, the buttocks and the waist are brought into close contact with the vane-shaped cushioning plate 22 while the auxiliary exercise chair 50 is securely fixed to the base 15 and the person exercising grasps both sides of the seat part 52 of the auxiliary exercise chair 50 by both hands, respectively.

The procedures for conducting this exercise can be varied relying upon the stature and skillfulness of the person exercising, by which an exercise effect can be elevated as compared to the above-described method. Also, as the relaxing of the muscles is rapidly achieved, advantageous aspect of fatigue relief and circulation of blood can be effectively obtained. At this time, the head of the person exercising is supported by the headrest 55 rotatably fastened to the back support 54 of the auxiliary exercise chair 50.

Referring to FIGS. 7A through 7D, there are illustrated side views showing a method of back and neck exercises for relieving the back muscles and neck muscles' fatigue by relaxing the back muscles and the neck muscles.

The thicker rear 22-2 of the vane-shaped cushioning plate 22 is depressed by a lower portion of the back while the person exercising sits on the seat 25 having the higher front and the lower rear and grasps both sides of the seat 25 by both hands, respectively. The tips of the toes are supported against the projection 24 of the base 15 to prevent the toes from leaning the base 15. The upper body of the person exercising slides on the vane-shaped cushioning plate 22 from the higher front to the lower rear of the seat 25.

By doing this, the back slides in a state that it depresses the thicker rear 22-2 of the vane-shaped cushioning plate 22, and fine vibrating force of the vane-shaped cushioning plate 22 is moved through the back to the neck of the person exercising.

Accordingly, the fine vibrating force of the vane-shaped cushioning plate 22 relaxes the back and the neck to relieve fatigue thereof. While conducting these exercises, since the bending and extending of the leg are repeated and the sliding movement and an upward movement of the upper body are repeated, the leg exercise and the abdomen muscles exercise are simultaneously conducted.

By the back and neck exercises, the back muscles and the neck muscles' fatigue is relieved. In addition, due to the fact that the bending and extending of the leg are repeated and the sliding movement and an upward movement of the upper body are repeated, the leg exercise and the abdomen muscles exercise are simultaneously conducted.

The method of back and neck exercises can relax the back and the neck and at the same time, it is possible to achieve effects of the leg and abdomen muscles exercises.

Figure 8A:
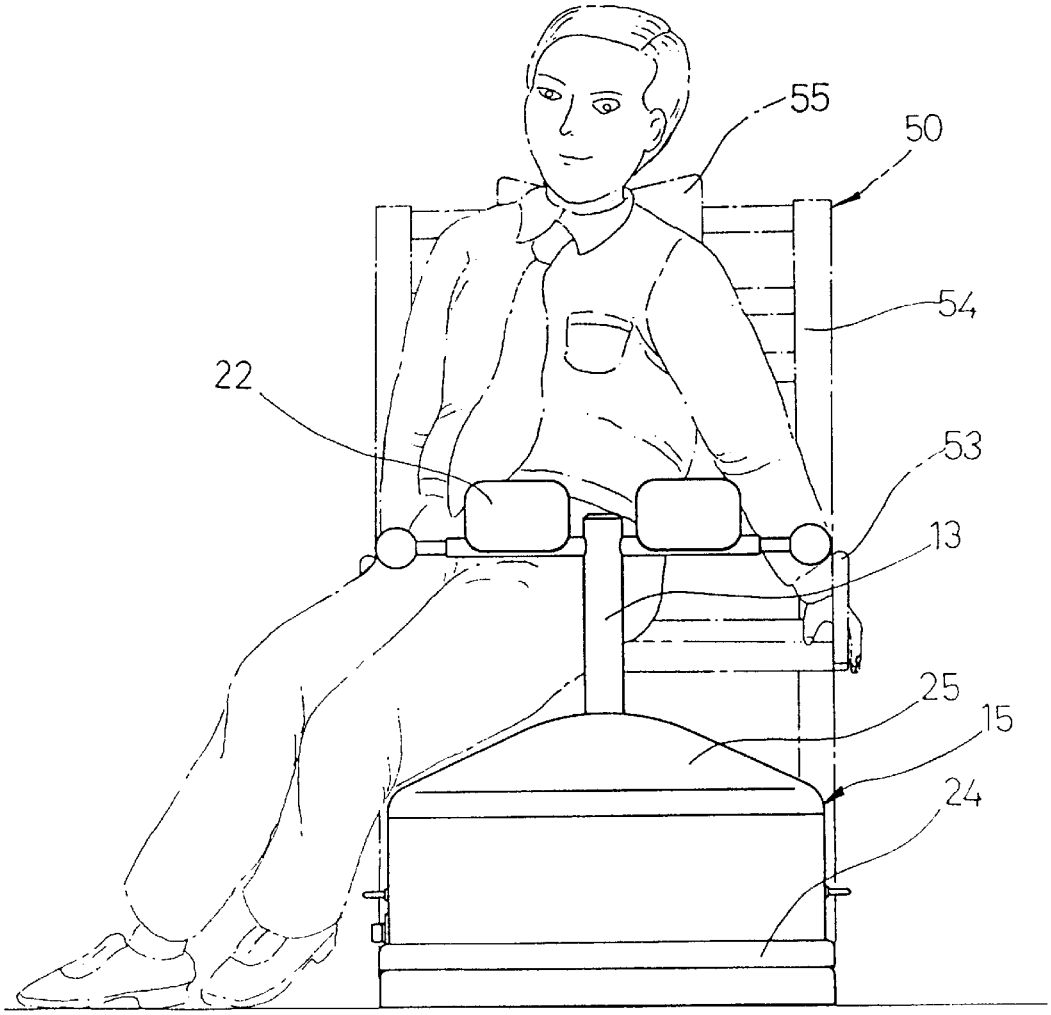
FIGS. 8A and 8B are side views showing a method of a groin exercise using the physical exercise device of the present invention.
Figure 8B:
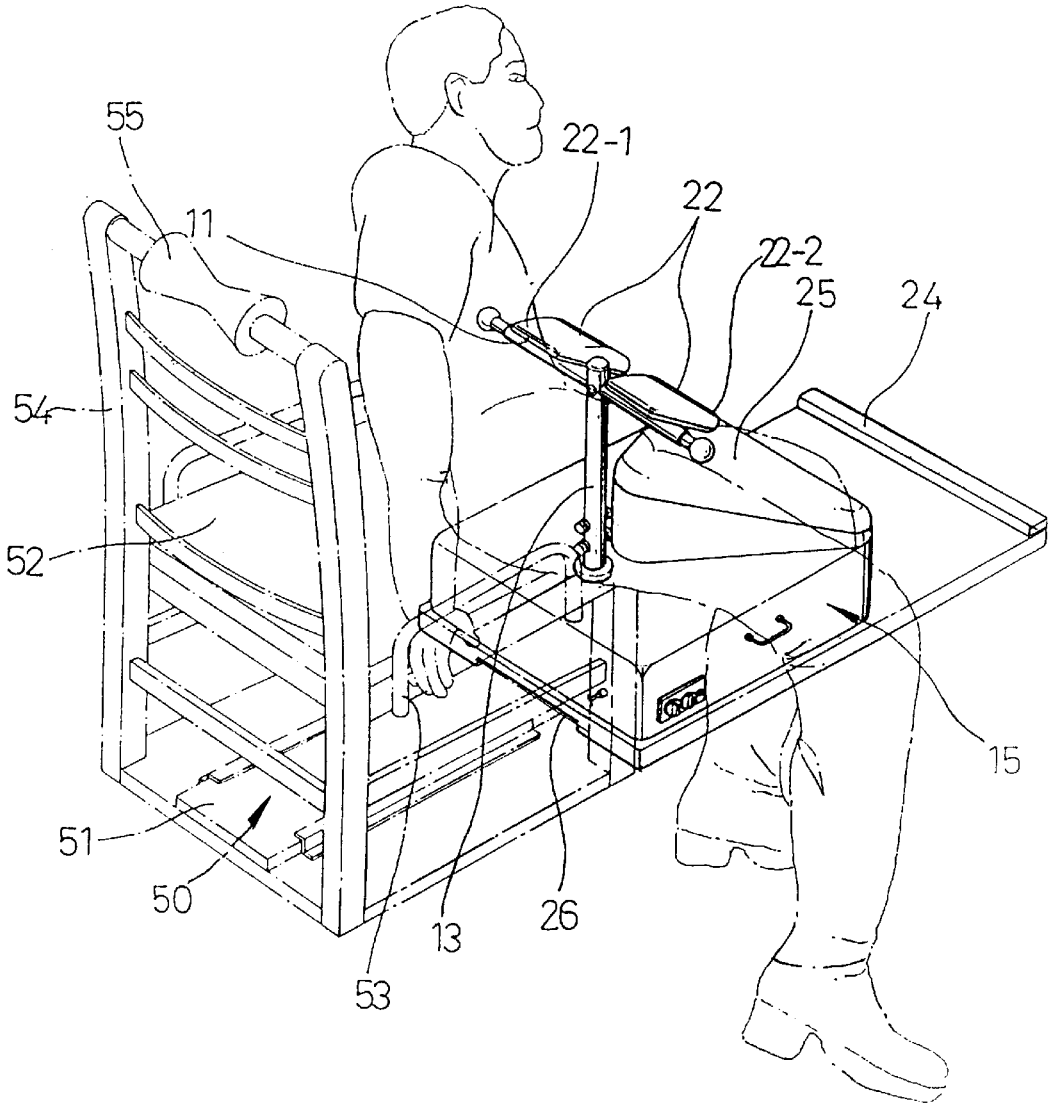
Figure 9A:
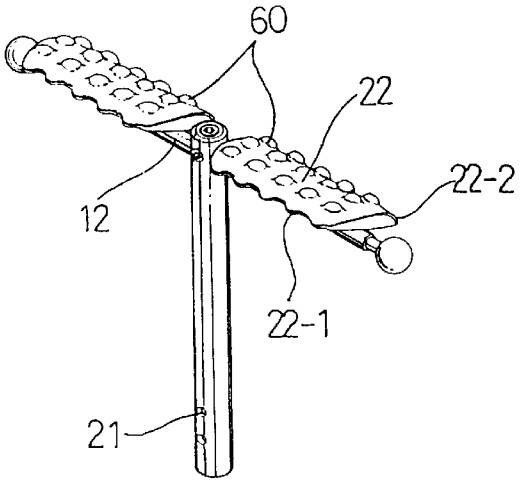
FIGS. 9A through 9E are perspective views illustrating vane-shaped cushioning plates in accordance with other embodiments of the present invention.
Figure 9B:
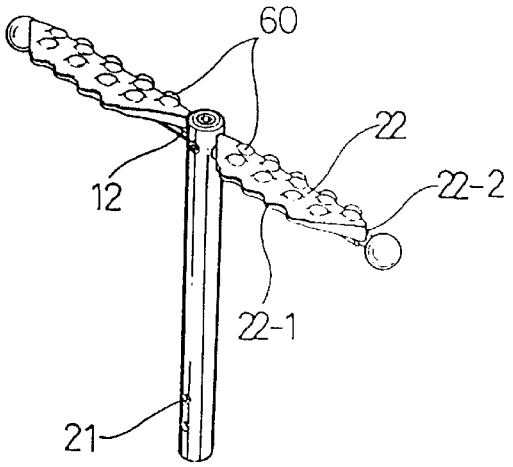
Figure 9C:
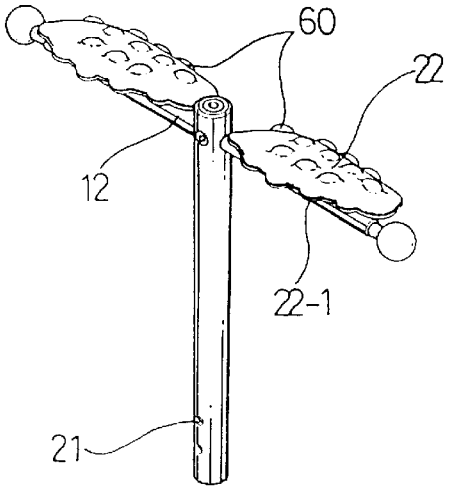
Figure 9D:
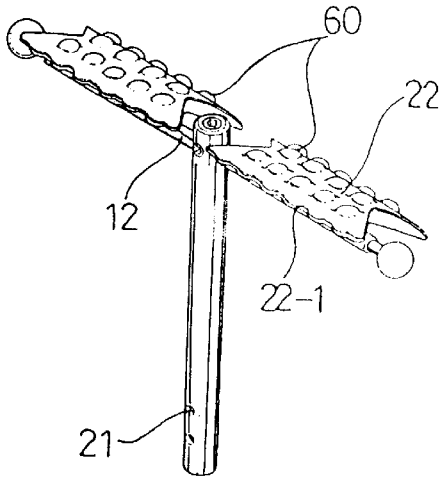
Figure 9E:
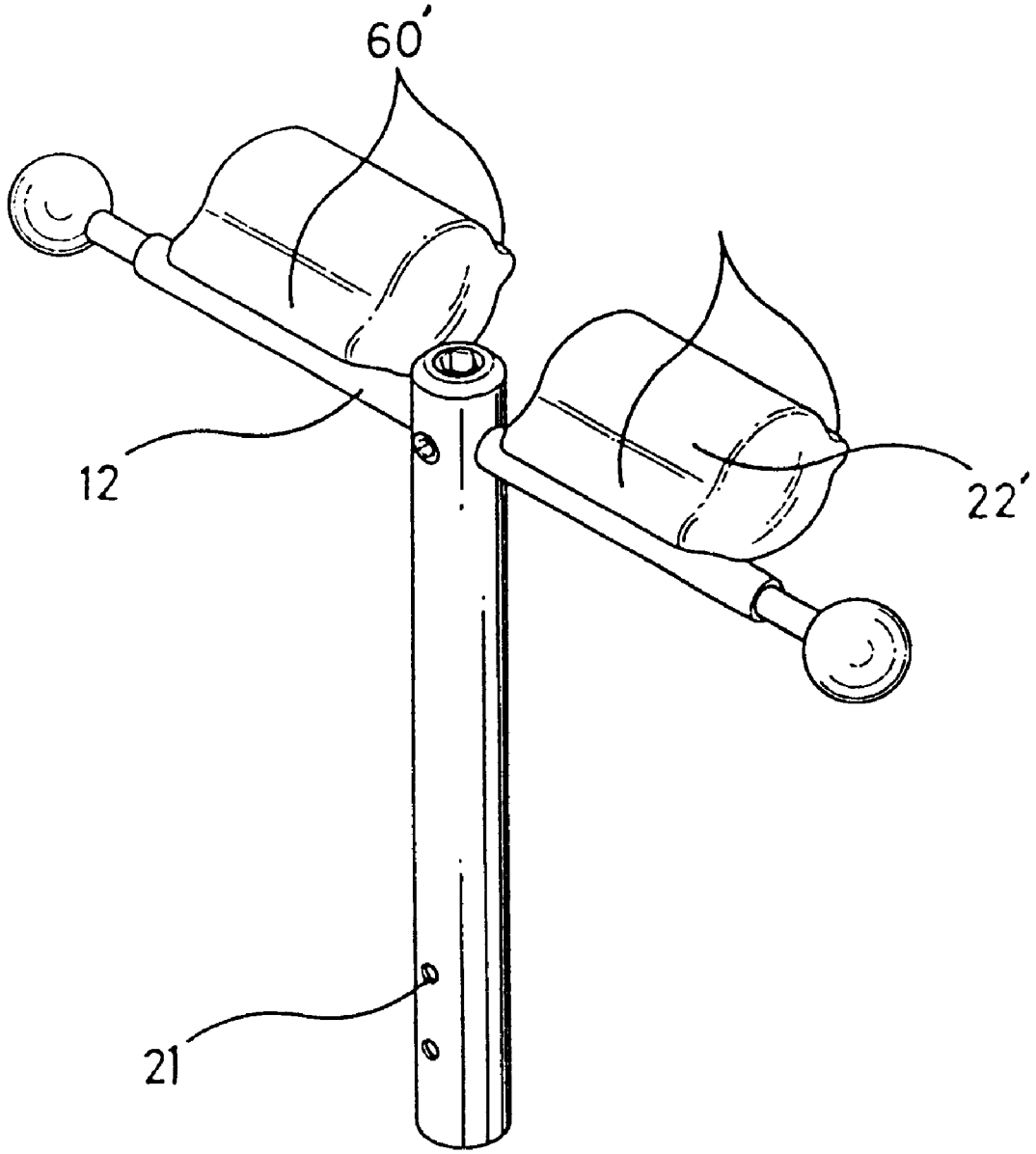

Referring to FIGS. 8A and 8B, there are illustrated side views showing a method of a groin exercise for relieving the groin muscles' fatigue by relaxing the groin muscles.

In this method, the auxiliary exercise chair 50 detachably joined to the base 15 is also advantageously used.

The legs of the person exercising are brought together while the person exercising sits on the auxiliary exercise chair 50 and grasps both sides of the seat part 52 of the auxiliary exercise chair 50 by both hands, respectively, to be supported by the safety handles 53. The legs are positioned underneath the horizontal rod 12. Then, a height of the horizontal rod 12 is adjusted by changing a position of a pin inserted into one of the first height-adjusting holes 20 and second height-adjusting holes 21 such that a lower portion of the horizontal rod 12 is located in the groin.

At this time, since the vane-shaped cushioning plate 22 is oscillated together with the hollow vertical rod 13 and the horizontal rod 12 due to the oscillating movement of the vertical rod 9, fine vibrating force relaxes the groin muscles.

When exercising using the device of the present invention, referring to FIGS. 9A through 9E, it is possible to increase a local finger-pressure type therapy effect by forming a plurality of protrusions 60 on surfaces of the vane-shaped cushioning plate 22 having the thinner front 22-1 and the thicker rear 22-2 or by forming bulge 60' of six and over on surfaces of the cylinder-shaped cushioning plate zz'.

Also, while it is not illustrated in the drawings, by using a spherical end finishing member for the horizontal rod 12 which is fixedly secured to the upper end of the hollow vertical rod 13 and has the vane-shaped cushioning plate 22 attached thereto, exercises for soothing an upset stomach and for beneficially effecting the intestines can be conducted.

When conducting these exercises, the person exercising is positioned at a side of the base 15 and a switch is turned on to operate an oscillating mechanism. Both hands of the person exercising can be supported by the seat part 52 of the auxiliary exercise chair 50 and a side of the base, respectively, by keeping a seated posture. Then, by conducting repeated sitting-down and standing-up movements or repeated leftward and rightward movements while adjusting vibrating force transmitted from the horizontal rod 12, the vibrating force can be conveyed to the abdomen of the person exercising.

As a result, by a physical exercise device using a T-shaped bar according to the present invention, advantages are provided in that it is possible to conduct a finger-pressure type treatment or a muscle relaxing exercise with a simple structure by using a T-shaped bar. Also, while jogging is a harmful exercise to a person with arthritis because the weight of the person exercising acts on the joints, a person having arthritis can conduct various exercises according to the present invention because the weight of the person exercising does not act on the joints in these described present exercises. Therefore, the device of the present invention can assist people in remedying arthritis, neuritis, rheumatism, etc. Also, since it is possible to conduct an exercise which strengthens one's body, when performing 30–60 minutes of exercise each day, the same effect of jogging over a 4–8 km distance can be obtained.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A physical exercise device using a T-shaped bar, comprising:

a base having a projection formed at one end thereof for engagement by a user's feet and a receiving groove defined at a lower surface thereof;

a motor mounted onto the base for generating driving force, the motor having a reduction gear;

a rotating shaft having one end coupled to a pulley to be rotatably driven by the driving force which is generated by the motor and is transmitted by way of a belt through the reduction gear;

an oscillating member having an eccentric cam which is fitted around the rotating shaft, the eccentric cam allowing the oscillating member to be oscillated with rotation of the rotating shaft;

a fixed member for rotatably supporting another end of the rotating shaft;

a connecting member having one end connected to the oscillating member;

a vertical rod connected to another end of the connecting member to be integrally oscillated with the oscillating member and having a plurality of first height-adjusting holes;

a hollow vertical rod telescopically fitted around the vertical rod and having a plurality of second height-adjusting holes;

a horizontal rod horizontally secured to the hollow vertical rod and having a pair of footrests fixed thereto;

a pair of cushioning plates attached to the pair of footrests, respectively, and each having a thinner front and a thicker rear;

a seat secured onto the base and having a higher front and a lower rear; and an auxiliary exercise chair, having a sliding plate carried thereby, detachably joined to the base by receipt of said sliding plate within said receiving groove.

2. The physical exercise device as claimed in claim 1, wherein the auxiliary exercise chair further comprises:

a pair of safety handles secured to both sides of a seat part of the auxiliary exercise chair, respectively; and a headrest secured to a back support of the chair.

3. The physical exercise device as claimed in claim 1, wherein a surface of each cushioning plate having the thinner front and the thicker rear is formed with a plurality of protrusions.

* * * * *